US006545210B2

(12) United States Patent
Morita

(10) Patent No.: US 6,545,210 B2
(45) Date of Patent: Apr. 8, 2003

(54) MUSICAL SOUND GENERATOR

(75) Inventor: Toru Morita, Tachikawa (JP)

(73) Assignee: Sony Computer Entertainment Inc., Tokyo (JP)

( * ) Notice: Subject to any disclaimer, the term of this patent is extended or adjusted under 35 U.S.C. 154(b) by 0 days.

(21) Appl. No.: 09/798,069

(22) Filed: Mar. 2, 2001

(65) Prior Publication Data

US 2001/0025562 A1 Oct. 4, 2001

(30) Foreign Application Priority Data

Mar. 3, 2000 (JP) ..... 2000-059346
Nov. 13, 2000 (JP) ..... 2000-344903

(51) Int. Cl.[7] ..... G10H 1/06; G10H 7/00
(52) U.S. Cl. ..... 84/622
(58) Field of Search ..... 84/626, 662, 622

(56) References Cited

U.S. PATENT DOCUMENTS 5,473,107 A * 12/1995 Mizuno ..... 84/626 X
5,602,358 A * 2/1997 Yamamoto et al. ..... 84/662
5,703,312 A * 12/1997 Takahashi et al. ..... 84/626
5,763,800 A * 6/1998 Rossum et al. ..... 84/626 X
5,898,118 A * 4/1999 Tamura
5,982,902 A * 11/1999 Terano
5,998,724 A * 12/1999 Takeuchi et al. ..... 84/626 X
6,091,012 A * 7/2000 Takahashi ..... 84/626

FOREIGN PATENT DOCUMENTS

JP 9-97067 A 4/1997
JP 10-187449 A 7/1998
JP 10-228519 A 8/1998

* cited by examiner

*Primary Examiner*—Jeffrey Donels
(74) *Attorney, Agent, or Firm*—Frommer Lawrence & Haug LLP; William S. Frommer; Hans R. Mahr

(57) ABSTRACT

A highly expandable musical sound generator using a sound library. Each module receives pointer structures as an argument and executes a processing. Each pointer structures includes attribute data pointers, input data pointers and output data pointers.

10 Claims, 6 Drawing Sheets

| | |
|---|---|
| FUNCTION 1 | M1 M3 M2 M8 |
| FUNCTION 2 | M5 M4 M7 |
| FUNCTION 3 | M1 M6 M9 |

MUSICAL SOUND GENERATOR

The application claims a priority based on Japanese Patent Application No. 20900-59346 filed on (Mar. 3, 2000 and Japanese Patent Application No. 2000-344903 filed on November 13.

BACKGROUND OF THE INVENTION

The present invention relates to a musical sound generation technique, and more particularly, to a highly expandable technique of processing sound data.

Some musical sound generators which read musical score data and generate a sound have a group of functions called "sound library." The sound library stores modules used to perform various special effects. Each module reads musical score data, converts the form of the data to produce data representing individual musical notes, subjects the resultant data to a special effect processing such as delay and filtering, and controls the sound processor in a series of processing. More specifically, the modules include all the functions used for processing from the reading of the musical score data to the control of the sound processor.

SUMMARY OF THE INVENTION

Therefore, if for example only a part of a method of processing a special effect in a certain module should be modified, the entire module must be updated. A new function must, be added to another module in such a manner that the existing part of the module is not affected, which is not necessarily easy.

The present invention is directed to a solution to the above-described problem associated with the conventional technique and it is an object of the present invention to provide a highly expandable sound library or a musical sound generation technique using such a library.

In order to achieve the above-described object, the following processings are performed according to the present invention. More specifically, musical note data representing a sound state in each tone is generated based on the musical score data. The musical note data is read and synthetic sound data is generated based on the musical note, data for output. The synthetic sound data is read and a sound processor to generate a musical sound is controlled based on the synthetic sound data.

According to the present invention, a musical sound generator including an operation unit is used to perform the above-described processing.

DESCRIPTION OF THE PREFERRED EMBODIMENTS

An embodiment of the present invention will be now described in conjunction with the accompanying drawings.

Figure 1:
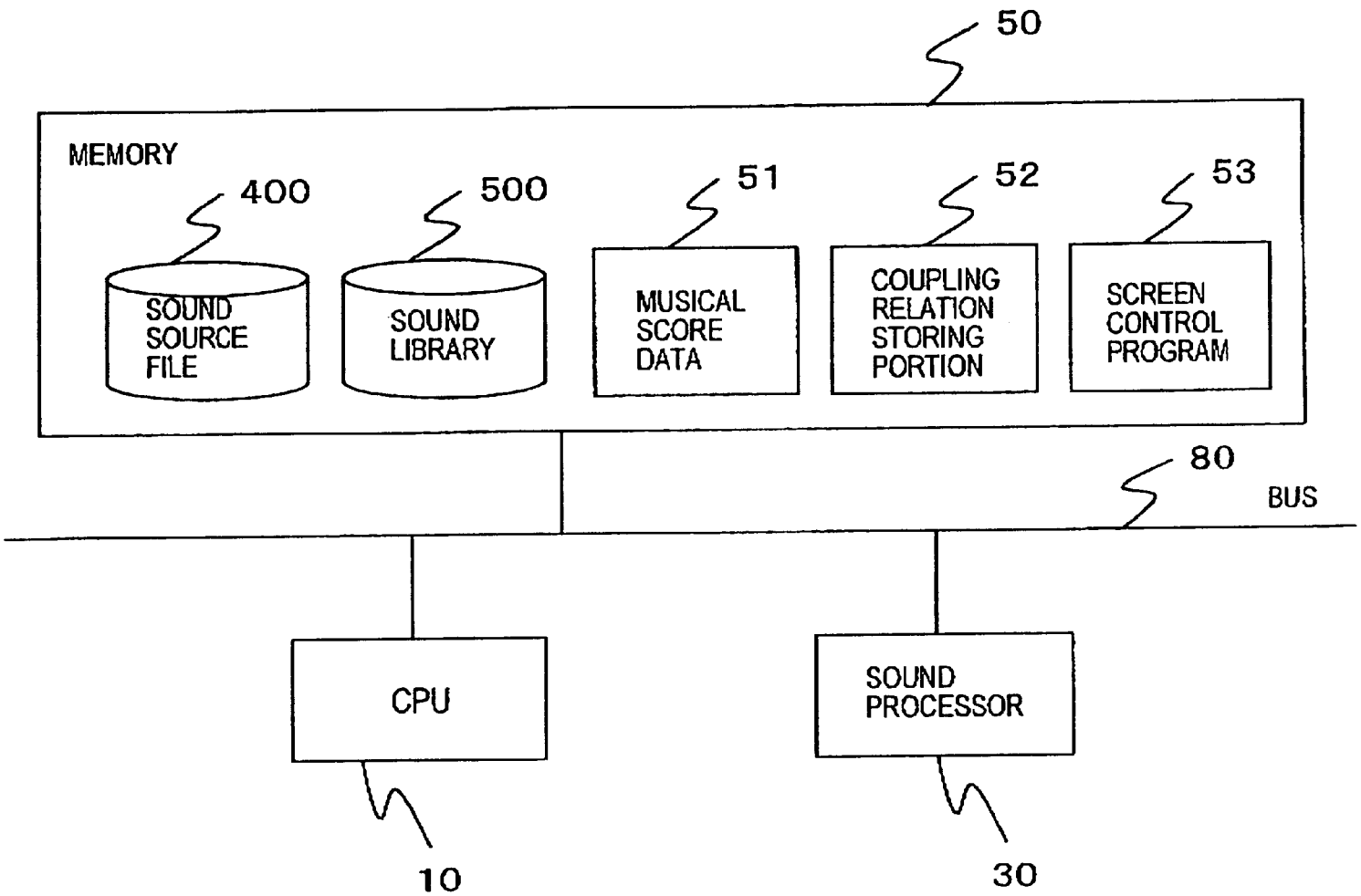
FIG. 1 is a diagram showing the hardware configuration of a musical sound generator according to an embodiment of the present invention.

FIG. 1 is a diagram showing a hardware configuration in a musical sound generator according to the embodiment of the present invention. The musical sound generator according to the embodiment includes a CPU (Central Processing Unit) 10, a sound processor 30, and a memory 50, and they are connected with each other by a bus 80.

The memory 50 stores a sound source file 400, a sound library 500, musical score data 51, a coupling relation storing portion 52, and a screen control program 53.

The sound source file 400 stores sound source data 410 based on which various sounds by various musical instruments are synthesized.

The sound library 500 stores modules for performing processings to output sounds by the musical sound generator.

The sound library 500 includes for example an input processing module 100 for reading the musical score data 51, sound synthesis processing module 200 for synthesizing a sound, a sound processor control module 300 for controlling the sound processor, a special effect module for providing a special effect such as filtering and echoing and the like.

The musical score data 51 is data produced by taking information represented by a musical score onto a computer.

The coupling relation storing portion 52 stores coupling relation information 520 about modules stored in the sound library 500. The coupling relation information 520 indicates the coupling relation between modules necessary for performing a prescribed function. An example of the coupling relation information 520 is shown in FIG. 6.

Figure 6:
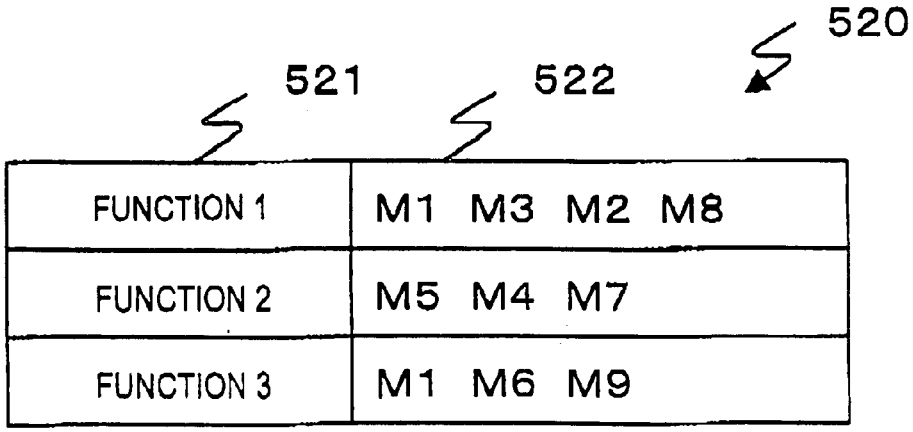
FIG. 6 is a diagram showing an example of coupling relation information according to the embodiment of the present invention.

In the example shown in FIG. 6, the coupling relation storing portion 52 stores the identifiers 522 of modules necessary for performing functions 521 in the order of execution. For example, the function 1 is implemented by executing the modules M1, M3, M2 and M8 in this order. Settlings for availability/unavailability for various special effect modules are included in the coupling relation storing portion 52.

The screen control program 53 is a program for input/output related to a setting for d special effect. For example, the screen control program 53 allows a display device (not shown) to display a special effect selection screen 600 which will be described.

Figure 2:
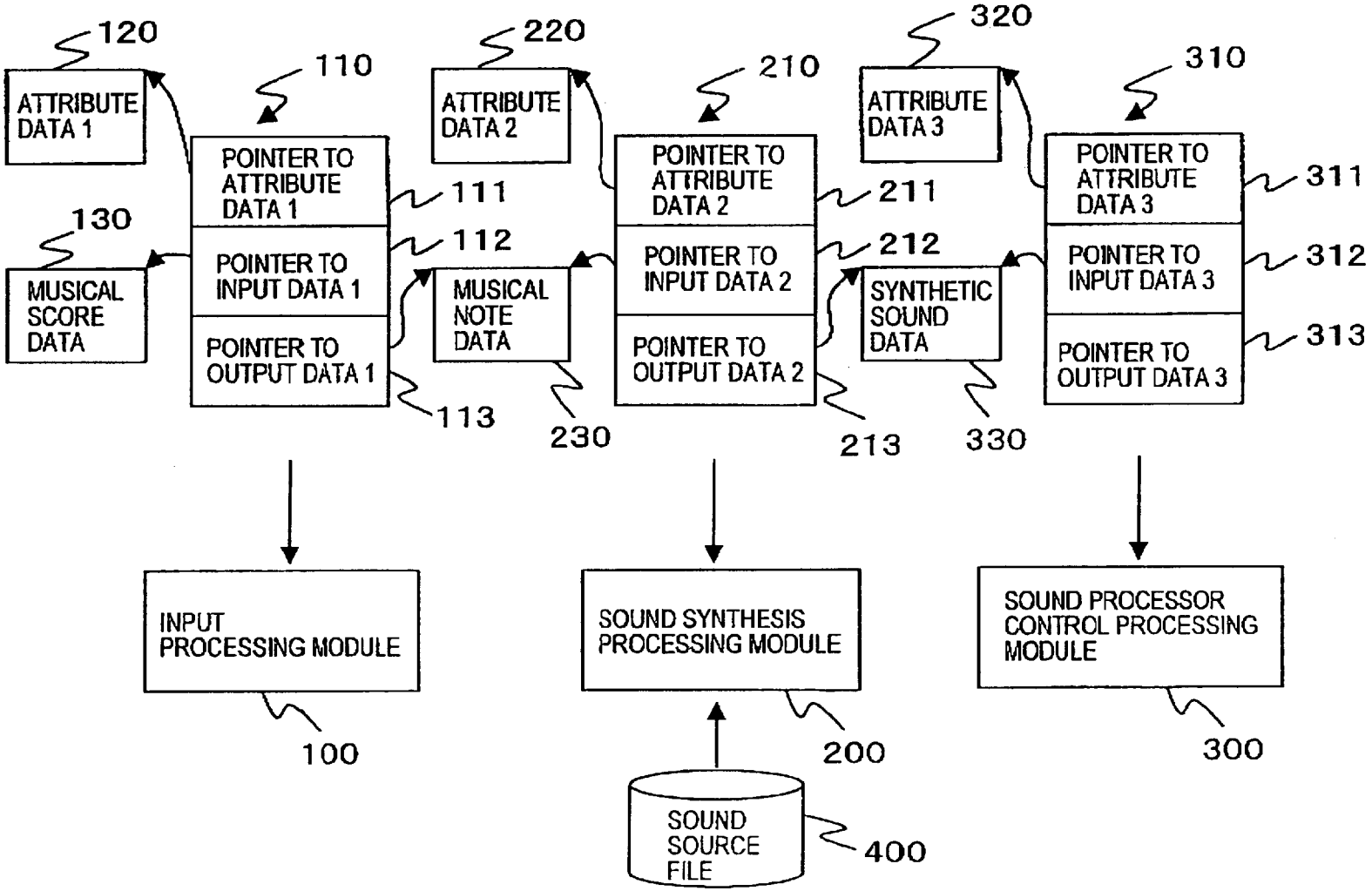
FIG. 2 is a diagram showing the module structure of a sound library and the data structure of input/output data to/from each module according to the embodiment of the present invention.

FIG. 2 is the module configuration of the sound library 500 according to the embodiment operated by the CPU 10 and the data structure of the input/output data to/from each module. The module and data structure described above are implemented by execution of programs included in the sound library 500 by the CPU 10.

The sound library 500 includes an input processing module 100, a sound synthesis processing module 200, a sound processor control processing module 300, and a sound source file 400. The modules 100, 200 and 300 receive pointer structures 110, 210 and 310, respectively as an argument for processing.

The pointer structures 110, 210 and 310 include regions 111, 211 and 311 storing pointers to attribute data, regions 112, 212 and 312 storing pointers to input data, and regions 113, 213 and 313 to storing pointers to output data, respectively. Each pointer region stores the address of buffer storing prescribed data or a buffer to store the data.

Attribute data 120, 220 and 320 include definition information and the like necessary for each module to operate. The attribute data 120, 220 and 320 are information inherent to each module.

The input processing module 100 reads musical score date 130 stored in a region pointed by the input data pointer 112 as input data. After the reading, the musical score date is analyzed, and musical note data 230 representing a tone and a sound state for each part of the musical score data is generated. The musical note data represents for example a sound state related to at least one of sound emission, sound stop, and the height of a sound to be emitted.

The input processing module 100 reads musical score data 130 stored in a region pointed by the input data pointer 112 as input data. After the reading, the musical score data is analyzed, and musical note data 230 representing a tone and a sound state for each part of the musical score data is generated. The musical note data represents for example a sound state related to at least one of sound emission, sound stop, and the pitch of a sound to be emitted. The generated musical note data 230 is output to a region pointed by the output data pointer 113. An example of the musical note data 230 is shown in FIG. 5.

Figure 5:
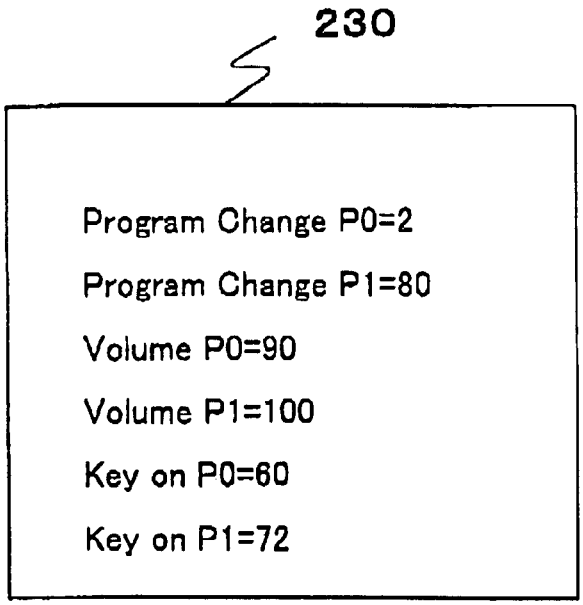
FIG. 5 is a diagram showing an example of musical note data according to the embodiment of the present invention.

The musical note data 230 shown in FIG. 5 has the following meaning. More specifically, "Program Change P0=2" means that "an identifier sets musical instrument 2 for part 0", while "Volume P0=90" means that "the sound volume of part 0 is set to 90." "Key on P0=60" means that "Emit sound 60 (middle do) for part 0." The part 1 is similarly set.

The sound synthesis processing module 200 reads musical note data 230 from a region pointed by the input data pointer 212 as an input. The musical note data 230 is output by the input processing module 100. More specifically, the output data pointer 113 and the input data pointer 212 point the same region. After the musical note data 230 is read, the sound synthesis processing module 200 takes sound source data 410 corresponding to all the tones, the height of sounds, and volumes represented by the musical note data 230 from the sound source file 400. The sound synthesis processing module 200 further synthesizes the taken sound source data 410 and generates coded synthetic sound data 330. The sound synthetic processing module 200 outputs the generated synthetic sound data 330 to a region pointed by the output data pointer 213.

The sound processor control processing module 300 reads the synthetic sound data 330 from a region pointed by the input data pointer 312 as an input. After the reading, the sound processor control processing module 300 controls the sound processor 30 based on the synthetic sound data 330 and emits a sound. In this case, the sound processor control processing module 300 simply emits a sound as an output, and does not write the output data to the buffer. Therefore, the output data pointer 313 does not store an address.

The input processing module 100, the sound synthesis processing module 200 and the sound processor control processing module 300 are executed in this order, and sounds based on the musical score data 130 are emitted.

Figure 3:
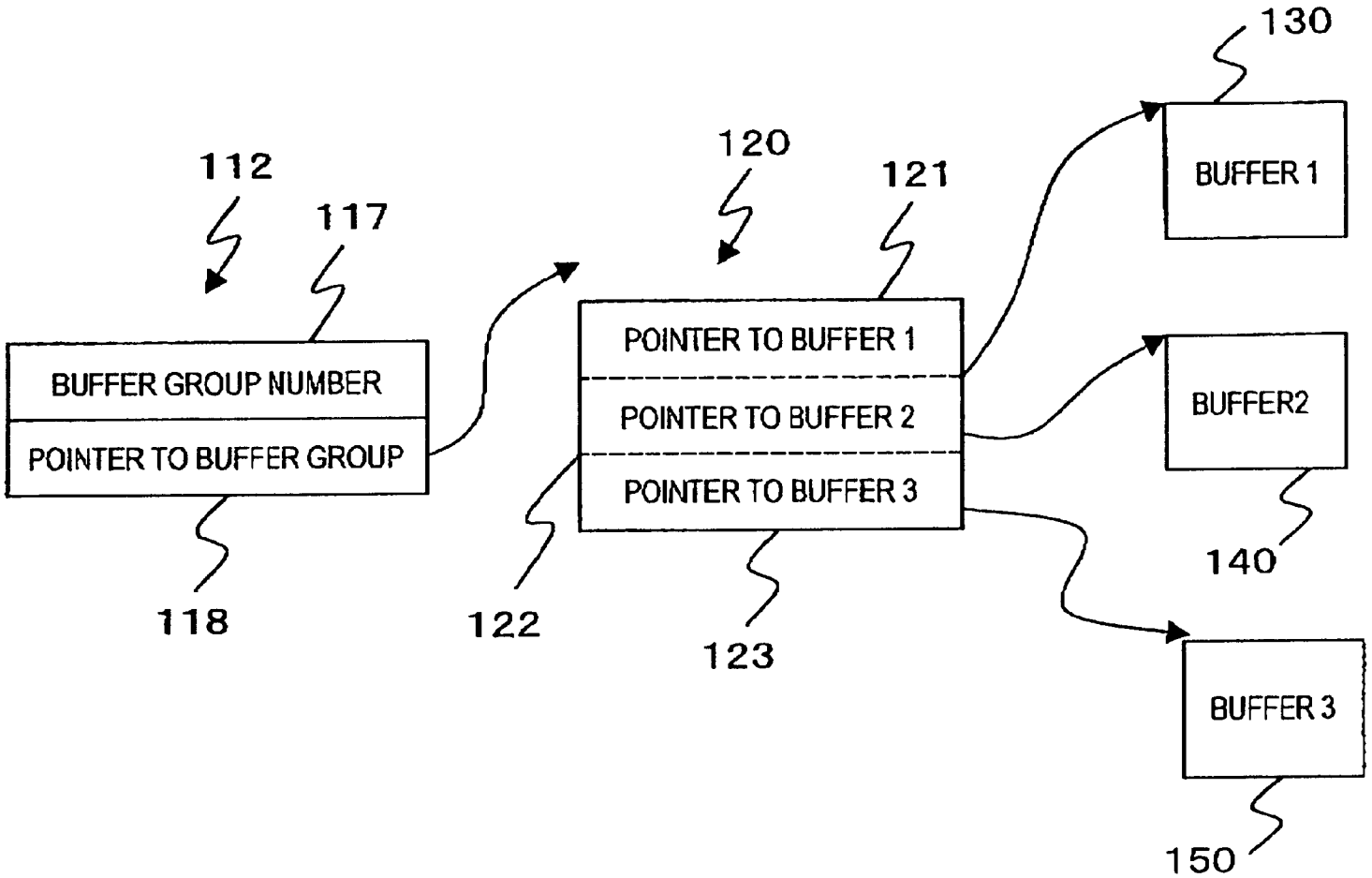
FIG. 3 is a diagram showing a hierarchical pointer structure according to the embodiment of the present invention.

Also according to the embodiment, the each region pointed by the input data pointers 112, 212 and 312 or the output data pointers 113, 213 and 313 stores one block data. A region pointed by a pointer may also store the pointer. In other words, the input data pointers 112, 212 and 312 or the output data pointers 113, 213 and 313 each may point a plurality of regions. The case of the input data pointer 112 will be detailed in conjunction with FIG. 3 by way of illustration.

The input data pointer 112 stores a buffer group number 117 and a buffer group pointer 118. The region pointed by buffer group pointer 118 stores pointers 121 to 123 directed to buffers belonging to the buffer group. The regions pointed by buffer pointers 121, 122 and 123 have buffers 135, 140 and 150, respectively. The buffers 135, 140 and 150 each store input data. Note that herein the buffer group refers to a plurality of buffers associated with one another into a group.

The buffer group is formed in this manner, and therefore if data is exchanged between modules using the pointer structures, the data may be exchanged to a plurality of buffers on a divisional data basis.

Furthermore, the sound library 500 is formed to have a module structure as shown in FIG. 2, and therefore each module may be substituted by another processing or another processing may be added as long as the forms of input/output data coincide. For example, when.the sound library 500 includes a special effect processing module for providing a special effect such as delay and filtering processings, the special effect processing module may be inserted between the sound synthesis processing module 200 and the sound processor control processing module 300.

Figure 4:
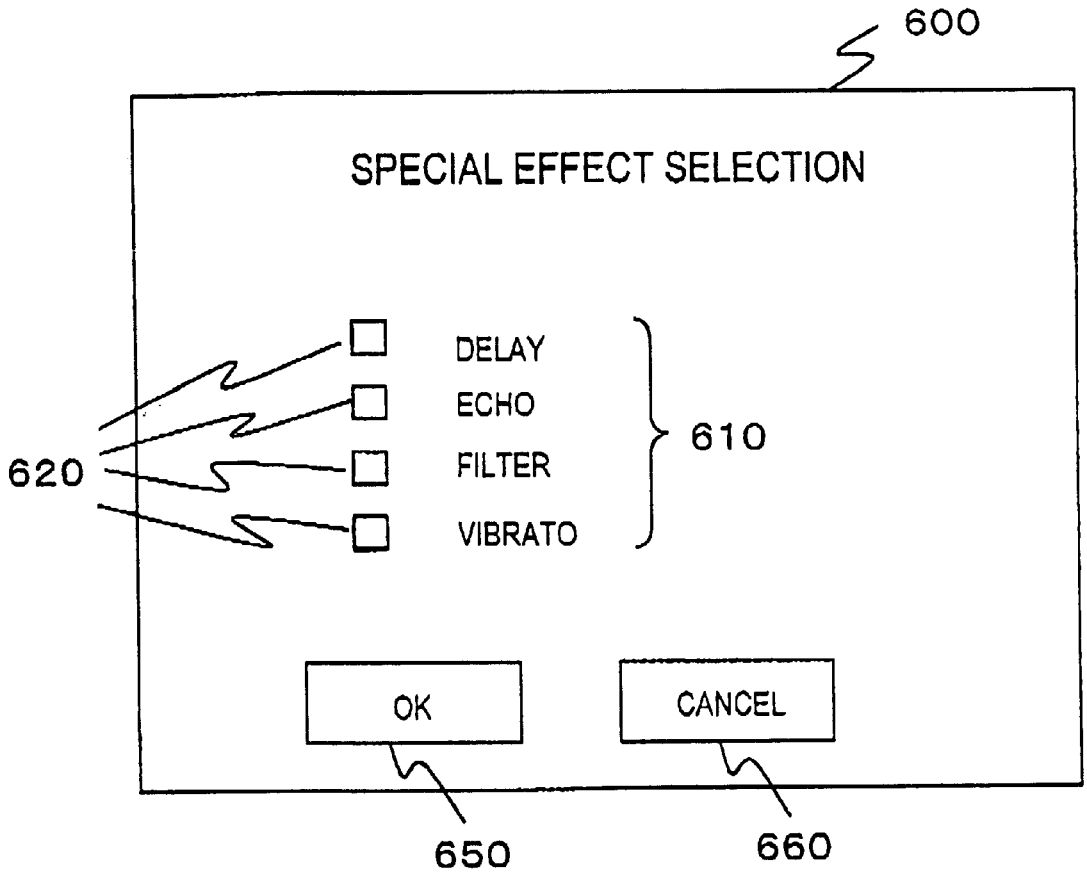
FIG. 4 is a diagram showing an example of a special effect selection screen according to the embodiment of the present invention.

Whether or not to incorporate such a special effect may be selected by the user of the musical sound generator. More specifically, a special effect selection screen 600 as shown in FIG. 4 may be prepared, and an instruction from the user may be received. Information set by the user is received by the special effect selection screen 600 and stored in the coupling relation storing portion 52. When a sound output processing is performed, a necessary module is read into the CPU 10 from the library by referring to the coupling relation storing portion 52.

The special effect selection screen 600 as shown in FIG. 4 is displayed at a display device which is not shown by the CPU 10 which has read the screen control program 53. The special effect selection screen 600 is provided with a special effect display portion 610, a selection receiving portion 620 to receive a selection for a special effect, an button 650, and a cancel button 660. The information received by the special effect selection screen 600 is stored by the coupling relation storing portion 52. Details of the special effect selected by the selection receiving portion 620 may be further set using a detail setting screen which is not shown.

Figure 7:
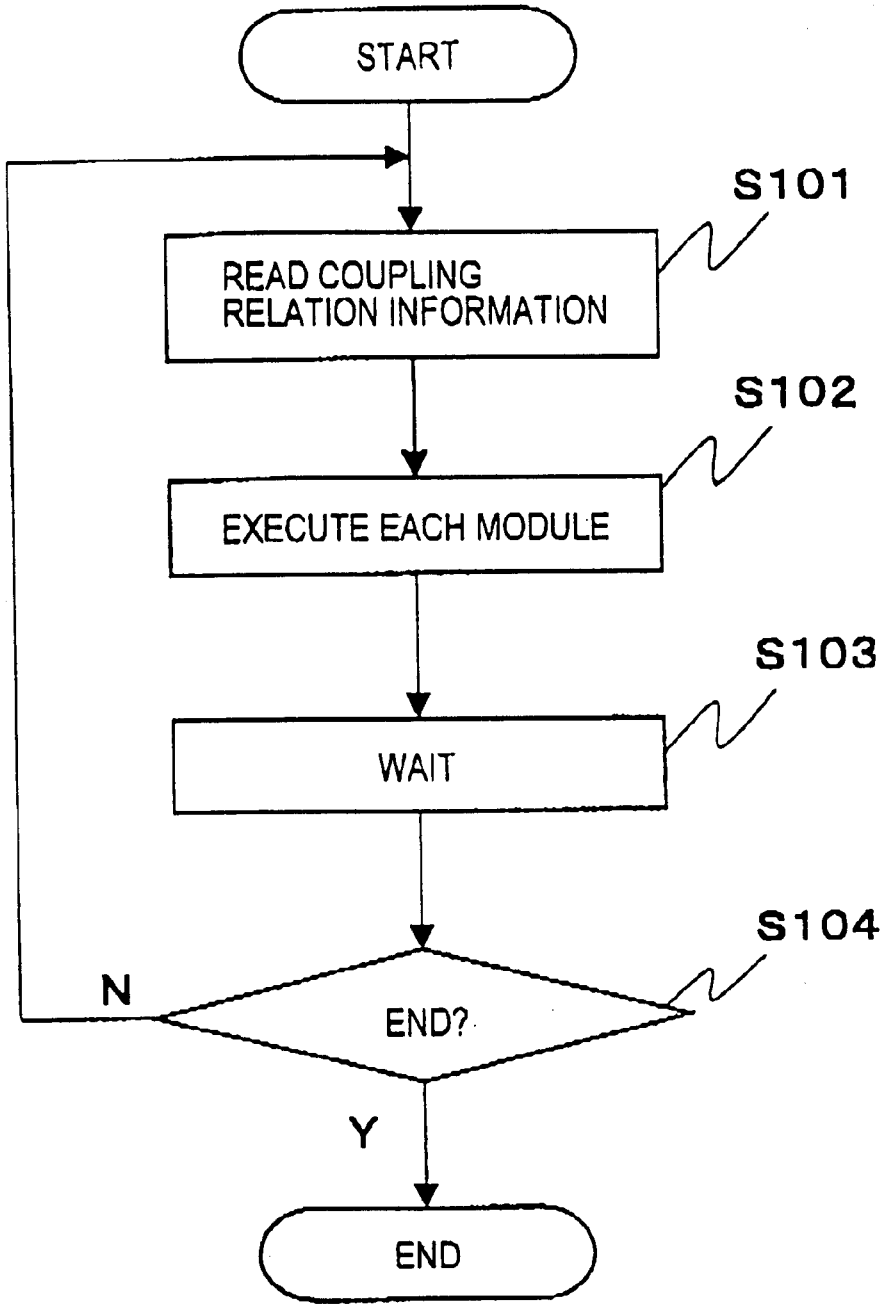
FIG. 7 is a flow chart for use in illustration of the process flow according to the embodiment of the present invention.

The process flow of the musical sound generator will be now described in conjunction with FIG. 7.

The main module in the sound library 500 reads the coupling relation information 520 from the coupling relation storing portion 52 (S101). Modules corresponding to a function to be implemented are sequentially executed (S102). The process waits for matching the timings as required (S103). The process from S101 to S103 is repeated until the end.

As in the foregoing, the updating of the coupling relation information 520 allows modules to be combined as desired.

According to the present invention the expandability of the sound library is increased.

What is claimed is:

1. A musical sound generator, comprising:

a musical score data input processing unit that generates musical note data based on musical score data, the musical note data representing a sound state of each tone;

a musical note data processing unit that generates synthetic sound data by synthesizing a plurality of tones based on the musical note data; and a musical sound generation processing unit that controls a sound processor for generating a musical sound based on the synthetic sound data; wherein each of the musical score data input processing unit, the musical note data processing unit and musical sound generation processing unit receives as an argument a pointer structure having a first region, a second region and a third region; wherein the first region is directed to an attribute data region storing attribute data related to a processing attribute inherent to each processing, the second region is directed to an input data region storing input data for each processing, and the third region is directed to an output data region storing output data for each processing, and wherein each processing unit, in each received pointer structure, reads the attribute data from the first region pointed to by a pointer when the pointer is set in the first region to perform each processing; and wherein each processing unit, in each received pointer structure, reads the input data from the second region pointed to by a pointer when the pointer is set in the second region to perform each processing; and wherein each processing unit, in each received pointer structure, writes output data to the region pointed to by a pointer when the pointer is set in the third region.

2. The musical sound generator according to claim 1, further comprising storing unit to store correspondence information about the relation between identification information about the musical score data input processing unit, identification information about the musical note data processing unit, identification information about the musical sound generation processing unit, and identification information about the at least one special effect processing unit, wherein musical sound generator executes each corresponding processing described above referring to the storing unit.

3. The musical sound generator according to claim 2 further comprising a changing unit for adding the identification information about the special effect processing unit to the correspondence information stored in the storing unit and for deleting the identification information about the special effect processing unit to the correspondence information stored in the storing unit.

4. A musical sound generator, comprising:

a musical score data input processing unit that generates musical note data based on musical score data, the musical note data representing a sound state by a musical instrument for each kind of musical instruments;

a musical note data processing unit that generates synthetic sound data by synthesizing sounds by a plurality of musical instruments based on the musical note data; and a musical sound generation processing unit that controls a sound processor for generating a musical sound based on the synthetic sound data; wherein each of the musical score data input processing unit, the musical note data processing unit and musical sound generation processing unit receives as an argument a pointer structure having a first region, a second region and a third region, and the first region is directed to an attribute data region storing attribute data related to a processing attribute inherent to each processing, the second region is directed to an input data region storing input data for each processing, and the third region is directed to an output data region storing output data for each processing; and wherein each processing unit, in each received pointer structure, reads the attribute data from the first region pointed to by a pointer when the pointer is set in the first region to perform each processing; and wherein each processing unit, in each received pointer structure, reads the input data from the second region pointed to by a pointer when the pointer is set in the second region to perform each processing; and wherein each processing unit, in each received pointer structure, writes output data to the region pointed to by a pointer when the pointer is set in the third region.

5. The musical sound generator according to claim 4, further comprising storing unit to store correspondence information about the relation between identification information about the musical score data input processing unit, identification information about the musical note data processing unit, identification information about the musical sound generation processing unit, and identification information about the at least one special effect processing unit, wherein musical sound generator executes each corresponding processing described above referring to the storing unit.

6. The musical sound generator according to claim 5 further comprising a changing unit for adding the identification information about the special effect processing unit to the correspondence information stored in the storing unit and for deleting the identification information about the special effect processing unit to the correspondence.

7. A storage medium storing a program readable and executable by a computer, the program enabling the computer having read the program to construct a musical sound generator;

the musical sound generator comprising;

a musical score data input processing unit that generates musical note data based on musical score data, the musical note data representing a sound state of each tone;

a musical note data processing unit that generates synthetic sound data by synthesizing a plurality of tones based on the musical note data; and a musical sound generation processing unit that controls a sound processor for generating a musical sound based on the synthetic sound data; wherein each of the musical score data input processing unit, the musical note data processing unit and musical sound generation processing unit receives as an argument a pointer structure having a first region, a second region and a third region, and the first region is directed to an attribute data region storing attribute data related to a processing attribute inherent to each processing, the second region is directed to an input data region storing input data for each processing, and the third region is directed to an output data region storing output data for each processing;

wherein each processing unit, in each received pointer structure, reads the attribute data from the first region pointed to by a pointer when the pointer is set in the first region to perform each processing;

wherein each processing unit, in each received pointer structure, reads the input data from the second region pointed to by a pointer when the pointer is set in the second region to perform each processing; and wherein each processing unit, in each received pointer structure, writes output data to the region pointed to by a pointer when the pointer is set in the third region.

8. A program readable and executable by a computer, wherein the program enabling the computer having read the program to construct a musical sound generator;

the musical sound generator comprising;

a musical score data input processing unit that generates musical note data based on musical score data, the musical note data representing a sound state of each tone;

a musical note data processing unit that generates synthetic sound data by synthesizing a plurality, of tones based on the musical note data; and a musical sound generation processing unit that controls a sound processor for generating a musical sound based on the synthetic sound data; wherein each of the musical score data input processing unit, the musical note data processing unit and musical sound generation processing unit receives as an argument a pointer structure having a first region, a second region and a third region, and the first region is directed to an attribute data region storing attribute data related to a processing attribute inherent to each processing, the second region is directed to an input data region storing input data for each processing, and the third region is directed to an output data region storing output data for each processing;

wherein each processing unit, in each received pointer structure, reads the attribute data from the first region pointed to by a pointer when the pointer is set in the first region to perform each processing;

wherein each processing unit, in each received pointer structure, reads the input data from the second region pointed to by a pointer when the pointer is set in the second region to perform each processing; and wherein each processing unit, in each received pointer structure, writes output data to the region pointed to by a pointer when the pointer is set in the third region.

9. A storage medium storing a program readable and executable by a computer, the program enabling the computer having read the program to construct a musical sound generator;

the musical sound generator comprising;

a musical score data input processing unit that generates musical note data based on musical; score data, the musical note data representing a sound state by a musical instrument for each kind of musical instruments;

a musical note data processing unit that generates synthetic sound data by synthesizing sounds by a plurality of musical instruments based on the musical note data; and a musical sound generation processing unit that controls a sound processor for generating a musical sound based on the synthetic sound data; wherein each of the musical score data input processing unit, the musical note data processing unit and musical sound generation processing unit receives as an argument a pointer structure having a first region, a second region and a third region, and the first region is directed to an attribute data region storing attribute data related to a processing attribute inherent to each processing, the second region is directed to an input data region storing input data for each processing, and the third region is directed to an output data region storing output data for each processing;

wherein each processing unit, in each received pointer structure, reads the attribute data from the first region pointed to by a pointer when the pointer is set in the first region to perform each processing;

wherein each processing unit, in each received pointer structure, reads the input data from the second region pointed to by a pointer when the pointer is set in the second region to perform each processing; and wherein each processing unit, in each received pointer structure, writes output data to the region pointed to by a pointer when the pointer is set in the third region.

10. A program readable and executable by a computer, wherein the program enabling the computer having read the program to construct a musical sound generator;

the musical sound generator comprising;

a musical score data input processing unit that generates musical note data based on musical score data, the musical note data representing a sound state by a musical instrument for each kind of musical instruments;

a musical note data processing unit that generates synthetic sound data by synthesizing sounds by a plurality of musical instruments based on the musical note data; and a musical sound generation processing unit that controls a sound processor for generating a musical sound based on the synthetic sound data; wherein each of the musical score data input processing unit, the musical note data processing unit and musical sound generation processing unit receives as an argument a pointer structure having a first region, a second region and a third region, and the first region is directed to an attribute data region storing attribute data related to a processing attribute inherent to each processing, the second region is directed to an input data region storing input data for each processing, and the third region is directed to an output data region storing output data for each processing;

wherein each processing unit, in each received pointer structure, reads the attribute data from the first region pointed to by a pointer when the pointer is set in the first region to perform each processing;

wherein each processing unit, in each received pointer structure, reads the input data from the second region pointed to by a pointer when the pointer is set in the second region to perform each processing; and wherein each processing unit, in each received pointer structure, writes output data to the region pointed to by a pointer when the pointer is set in the third region.

* * * * *